US009827575B2

(12) United States Patent
Sutherland et al.

(10) Patent No.: US 9,827,575 B2
(45) Date of Patent: Nov. 28, 2017

(54) CONTROLLED TURBULENT BREAKUP FLOW

(71) Applicant: Metso Minerals Industries, Inc., Waukesha, WI (US)

(72) Inventors: Kevin Sutherland, Peyton, CO (US); Brian Knorr, Henrico, VA (US); Lars Grönvall, Trelleborg (SE)

(73) Assignee: Metso Minerals Industries, Inc., Waukesha, WI (US)

( * ) Notice: Subject to any disclaimer, the term of this patent is extended or adjusted under 35 U.S.C. 154(b) by 0 days.

(21) Appl. No.: 14/974,441

(22) Filed: Dec. 18, 2015

(65) Prior Publication Data

US 2017/0173598 A1 Jun. 22, 2017

(51) Int. Cl.

| | |
|---|---|
| ***B04C 3/06*** | (2006.01) |
| ***B03B 5/34*** | (2006.01) |
| ***B04C 11/00*** | (2006.01) |
| ***B04C 5/081*** | (2006.01) |
| ***B04C 5/085*** | (2006.01) |
| ***B04C 5/103*** | (2006.01) |
| *B04C 3/00* | (2006.01) |

(52) U.S. Cl.

CPC ..... *B04C 3/06* (2013.01); *B03B 5/34* (2013.01); *B04C 5/081* (2013.01); *B04C 5/085* (2013.01); *B04C 5/103* (2013.01); *B04C 11/00* (2013.01); *B04C 2003/003* (2013.01)

(58) Field of Classification Search

CPC ..... B04C 3/06; B04C 11/00; B03B 5/34
USPC ..... 209/132, 142, 143, 145, 160, 161, 208, 209/210, 424, 434, 459, 460, 506, 725
See application file for complete search history.

(56) References Cited

U.S. PATENT DOCUMENTS

| | | | | |
|---|---|---|---|---|
| 2,338,779 | A | 1/1944 | Mutch | |
| 2,534,702 | A | 12/1950 | Driessen | |
| 2,735,547 | A | 2/1956 | Vissac | |
| 3,235,091 | A | 2/1966 | Doll et al. | |
| 3,347,372 | A | 10/1967 | Bouchillon | |
| 3,353,673 | A | 11/1967 | Visman | |
| 3,419,152 | A | 12/1968 | Ramond | |
| 3,926,787 | A | 12/1975 | Gay | |
| 4,053,393 | A * | 10/1977 | Day | B04C 5/085 209/719 |

(Continued)

FOREIGN PATENT DOCUMENTS

| | | |
|---|---|---|
| AU | 82432/87 | 6/1988 |
| CA | 1104094 | 6/1981 |

(Continued)

OTHER PUBLICATIONS

International Search Report and Written Opinion for International Application No. PCT/IB2016/057666 dated Feb. 22, 2017.

(Continued)

*Primary Examiner* — Terrell Matthews
(74) *Attorney, Agent, or Firm* — Andrus Intellectual Property Law, LLP

(57) ABSTRACT

A hydrocyclone separator for classifying solid material in liquid suspension is disclosed. The hydrocyclone separator includes a head part having an inlet conduit and a conically tapered separation part. The hydrocyclone separator includes one or more internal edges that disturb the flow of material within the hydrocyclone separator.

12 Claims, 6 Drawing Sheets

(56) References Cited

U.S. PATENT DOCUMENTS

| | | | | | |
|---|---|---|---|---|---|
| 4,224,145 | A * | 9/1980 | Skardal | B04C 5/14 | 209/733 |
| 4,226,708 | A | 10/1980 | McCartney | | |
| 4,539,105 | A | 9/1985 | Metcalf | | |
| 4,652,363 | A * | 3/1987 | Miller | B04C 5/02 | 209/734 |
| 4,715,951 | A * | 12/1987 | Krambrock | B07B 4/02 | 209/138 |
| 4,721,565 | A | 1/1988 | Carroll | | |
| 5,037,558 | A | 8/1991 | Kalnins | | |
| 5,071,556 | A | 12/1991 | Kalnins et al. | | |
| 5,071,557 | A | 12/1991 | Schubert et al. | | |
| 5,110,471 | A | 5/1992 | Kalnins | | |
| 5,437,794 | A * | 8/1995 | Andersson | B04C 5/081 | 209/719 |
| 5,819,955 | A * | 10/1998 | Clarke | B04C 5/06 | 209/732 |
| 5,858,237 | A | 1/1999 | Hashmi et al. | | |
| 6,071,424 | A * | 6/2000 | Tuszko | B01D 17/0217 | 209/715 |
| D456,429 | S | 4/2002 | Rogers et al. | | |
| 6,419,719 | B2 * | 7/2002 | Conrad | A47L 9/1608 | 209/711 |
| D464,067 | S | 10/2002 | Rogers et al. | | |
| 7,293,657 | B1 * | 11/2007 | Kelton | B03B 5/34 | 209/715 |
| 8,911,635 | B2 * | 12/2014 | Capela Moraes | B01D 17/0217 | 209/727 |
| 9,254,458 | B2 * | 2/2016 | Jensen | B01D 46/0046 | |
| 2017/0173598 | A1 * | 6/2017 | Sutherland | B03B 5/34 | |

FOREIGN PATENT DOCUMENTS

| | | |
|---|---|---|
| CA | 2115077 | 8/1995 |
| DE | 754339 | 10/1951 |
| DE | 3244336 | 6/1983 |
| GB | 1015865 | 1/1966 |
| WO | 2009153980 | 12/2009 |

OTHER PUBLICATIONS

Olsen, T.J. et al., "Optimizing hydrocyclone design using advanced CFD model." (2004) Minerals Engineering 17(5): 713-720.

"Krebs gMAX hydrocyclones" FLSmidth Krebs Brochure (2011): 1-5.

* cited by examiner

CONTROLLED TURBULENT BREAKUP FLOW

FIELD OF THE INVENTION

The present invention relates to an apparatus for classifying particulate material, e.g., aggregates, and in particular to classification using a hydrocyclone.

BACKGROUND

In general, classification can be described as a method of separating mixtures of e.g. particles into two or more products. It is known to use hydrocyclones for performing classification of particulate material and they have proven very efficient at fine separation sizes. Often, hydrocyclones comprise a cylindrical top portion into which a slurry containing the particles to be classified is fed and an overflow is provided at the top of the cylindrical top portion. Attached to a lower end of the top portion is a conically shaped vessel which is open at its smallest end. The slurry is typically fed tangentially or in a volute path to the outer wall of the top portion, thus creating a whirling stream of the slurry which stream follows a path of gradually decreasing radius toward a point close to the narrowest radius of the cone, commonly known as the apex. As the spiral path approaches the apex of the hydrocyclone, a portion of it turns and begins to flow towards the opposite end, i.e. towards the cylindrical section. Also this flow is in a spiral path but of a radius smaller than the radius of the first spiral while rotating in the same direction. Thus a vortex is generated within the hydrocyclone. The pressure will be lower along the central axis of the vortex and increase radially outwardly towards the outer wall of the hydrocyclone. The idea is that the hydrocyclone will separate the particles of the slurry according to shape, size and specific gravity with faster settling particles moving towards the outer wall of the hydrocyclone eventually leaving the hydrocyclone through the underflow. Slower settling particles will move towards the central axis and travel upwardly, eventually leaving the hydrocyclone through a discharge tube (overflow). The discharge tube is normally extending down into the cylindrical section such that short-circuiting of the feed is prevented. This is also known as a "vortex finder". This separation according to shape, size and specific gravity is sometimes denominated "stratification". However, this stratification of the material is not always fully achieved thus causing an incomplete classification.

SUMMARY

An object of the invention is to overcome, or at least lessen the above mentioned problems. A particular object is to provide a hydrocyclone with improved stratification properties.

According to the invention, these and other objects are achieved, in full or at least in part, by a hydrocyclone separator for classifying solid material in liquid suspension as disclosed. The hydrocyclone separator comprises a head part having an inlet conduit and a conically tapered separation part. According to the invention the hydrocyclone separator comprises one or more internal edges that disturb the flow of material within the hydrocyclone separator.

According to a first aspect of the invention, these and other objects are achieved, in full or at least in part, by a hydrocyclone separator for classifying solid material in fluid suspension, comprising at least a head part having an inlet conduit adapted to feed a suspension into the head part and a conically tapered separation part. According to this first aspect, the upper end of the conically tapered separation part is coupled to a lower end of the head part and the inner diameter at the upper end of the conically tapered separation part is greater than the inner diameter at the lower end of the head part. This difference in diameters creates an edge on the inner surface of the hydrocyclone which will disturb the flow of material passing said edge during use of the hydrocyclone. As the flow of particles passes over the edge they are disturbed to a certain degree and particles stuck to each other may break loose from each other. Also, by creating a disturbance in the material flow against the walls of the cyclone coarser material can be forced away from the wall to re-mix with adjacent flow for the purpose of dislodging build-up against the walls and freeing entrained fine materials from the wall region which were trapped by the coarse build-up. Put another way, the provision of an edge, particles that for some reasons are entrapped in an incorrect position within the hydrocyclone can be freed and be allowed to assume a correct position. Thereby stratification of the flow of material and the quality of classification can be improved. Further, as indicated above, the pressure in a hydrocyclone varies along a radius thereof and the difference in pressure occurring at an edge, due to the variation in diameter will cause particles to be set free and allowed to re-mix within the hydrocyclone. Thus, if for example a very small particle that is initially stuck onto a larger particle can be released, it can assume its correct position within the hydrocyclone, i.e. move more towards the central axis of the hydrocyclone and leave the hydrocyclone via the overflow. This stands in sharp contrast to the situation where it remains stuck to the larger particle in which case it would follow the larger particle towards the periphery of the hydrocyclone and incorrectly leave the hydrocyclone via the underflow instead.

According to a second aspect of the invention, these and other objects are also achieved, in full or at least in part, by a hydrocyclone separator for classifying solid material in fluid suspension, comprising at least a head part having an inlet conduit adapted to feed a suspension into the head part and a conically tapered separation part. According to this second aspect, the upper end of the conically tapered separation part is coupled to a lower end of the head part and a groove is provided on an inner surface of the conically tapered separation part such that an edge is created which disturbs a flow of material passing said edge. The edge disturbing the flow of material is provided by a groove on the inner surface of the conically tapered separation part. Here, it is understood that the groove can be constituted by a recess or a protrusion provided at the inner surface, or a combination of the both. Both the protrusion and the recess ensure the desirable disturbance of the flow such that stratification is improved. The provision of the groove at the inner surface of the conically tapered separation part makes it possible to achieve a required disturbance at a specific position within the hydrocyclone. The size distribution of particles within a hydrocyclone during use is by no means homogenous and having the whole inner surface of the separation part of the hydrocyclone available, the groove, or grooves, can be located at the most suitable position or positions to achieve best possible stratification.

According to a third aspect of the invention, these and other objects are also achieved, in full or at least in part, by a hydrocyclone separator for classifying solid material in fluid suspension, comprising at least a head part having an inlet conduit adapted to feed a suspension into the head part and a conically tapered separation part. According to this third aspect, the conically tapered separation part is constituted by a conically tapered hose segment and an upper end of the conically tapered hose segment is coupled to a lower end of the head part. The inner diameter at the upper end of the conically tapered hose segment is greater than the inner diameter at the lower end of the head part such that an edge is created which disturbs a flow of material passing said edge. The use of a hose segment provides for a durable separation part since hose material typically has good wear properties and which can easily be provided with e.g. ceramics or other wear improving material on an inner surface. Furthermore, hosing material is flexible and if desired it can adapt its shape to the load applied to it. A hose is typically a layered product manufactured on a mandrel which design can easily be adapted as desired in order to achieve a shape optimized for a specific process. Even complicated shapes with varying radiuses and diameters of the hose segment can be achieved without much extra work. The stiffness of the hose segment can also be adapted as required in each and every specific situation by providing a hose segment with a suitable numbers of layers, (e.g. an interior wear layer, a support and an exterior cover layer) having respective stiffness properties. In comparison with separation parts made from e.g. steel a hose segment is easier to manufacture, cheaper and more formable and even very complicated shapes can be manufactured in one single piece. Since no complicated and expensive moulds are required, the manufacturing costs can be kept at bay. By arranging a flange at the end of the hose segment a simple and reliable connection to the head part can be achieved and exchange of worn out parts is further simplified by the fact that a hose segment can be provided in a single element without any wrapping or similar.

In one of the embodiments, the groove is provided in the form of a projection protruding from the inner surface of the conically tapered separation part. By providing the inner surface of the conically tapered separation part with a protruding groove, disturbance of the flow of material can be provided to a required extent. The protrusion can be achieved directly in e.g. a moulding process of the separation part or added onto the surface at a separate stage.

In one of the embodiments, the groove is provided in the form of a recess in the inner surface of the conically tapered separation part. By providing the inner surface of the conically tapered separation part with a recess, the disturbance of the flow of material can be provided to a required extent. The recess can be achieved directly in e.g. a moulding process of the separation part or machined or similar into the surface at a separate stage.

In one of the embodiments, the groove extends in the shape of an arc. It is not necessary that the groove extends around the whole perimeter of the cone.

In one of the embodiments, the groove extends along a perimeter of the conically tapered separation part. By providing one or more grooves extending along a whole perimeter of the inner surface of the cone, sufficient disturbance of the flow can be achieved at desired locations within the hydrocyclone.

In one of the embodiments, the groove extends along a helical path on the inner surface of the conically tapered separation part. By arranging the groove in a helical pattern at the inner surface of the conically tapered separation part, continuous disturbance of the flow of material is achieved.

In one of the embodiments, the helical path on the inner surface of the conically tapered separation part extends countercurrent to a flow of the solid material in fluid suspension. The disturbance can be further improved if the helical groove runs in a countercurrent direction to the flow of material.

In one of the embodiments, the conically tapered separation part comprises a plurality of portions and wherein an inner diameter of a lower end of an upper portion is less than an inner diameter of an upper end of an adjacent lower portion such that a second edge is created. This allows for adaption of the size of the edge since it will be possible to arrange portions of different diameters adjacent each other in order to create an edge with desired properties in different situations.

In one of the embodiments, the conically tapered separation part comprises a plurality of portions and wherein the different portions have different taper angles, or cone angles, in order to adapt to e.g. different flow speeds in different portions.

In one of the embodiments, the hose segment comprises an interior wear layer having an inner surface, adapted for contact with solid material in a fluid, and an outer surface. The hose segment further comprises a support structure wound, woven or braided about said outer surface and an exterior cover layer being disposed over said support structure. In this embodiment, the hose segment may further comprise a monitoring system comprising at least one moisture sensor arranged to detect moisture in or at said support structure as well as communication means coupled to said moisture sensor for providing a signal representative of moisture detection in or at said support structure. Since the particle flow typically comprises liquid in the form of water, a moisture sensor arranged within the hose segment can be used as a wear indicator. By using the supporting structure for sensing moisture, any leakage along the longitudinal direction of the separation part will give a detection, as the supporting structure is wound, woven or braided around the outer surface of the inner wear layer along the longitudinal direction of the separation part and will lead and guidance fluid from said leakage along the longitudinal direction of the separation part to said at least one sensor, and the communication means will present the moisture detection, giving the plant operator an early warning of the wear of the separation part. By creating a cavity between the supporting structure and an adjacent layer of the hose segment, it is ensured that any water or other liquids is guided towards the moisture and/or the pressure sensor of the monitoring system. Often, rubber is used in hoses and if a rubber layer being adjacent the support structure, for example in the form of a spiral steel cord, is not vulcanized to the support structure, such cavity is easily created.

In one of the embodiments, said support structure has a structure which guides or leads fluid along its structure. This ensures that a leak is guided towards the at least one moisture sensor such that an indicated wear can be communicated.

In one of the embodiments, said support structure comprises a steel cord.

In one of the embodiments, the monitoring system further comprises at least one pressure sensor arranged to measure the pressure in or at said support structure and communication means coupled to said pressure sensor for providing a signal representative of pressure detection in or at said support structure. With such an arrangement, the moisture sensor may provide a first indication of wear and leaking, while the pressure sensor measures the pressure within the supporting structure and may provide a second indication of wear and alarm at a predetermined threshold value before the pressure build up within the separation part will give rise to a danger or a critical situation.

In one of the embodiments, the support structure comprises at least one cord layer wound about said outer surface. The cord with its warp wires will lead and guide the fluid leakage along the supporting structure to the sensor and will give an indication on the sensor and so forth.

In one of the embodiments, the support structure comprises a spiral structure wound about said outer surface or about said at least one cord layer. Such a spiral structure will provide a circumferential cavity around the spiral structure, and fluid leaking into the layer with the spiral structure will enter into this circumferential cavity and travel along the spiral structure and will give indication on the sensor when reaching the area within the supporting structure having a moisture sensor. By using the circumferential cavity around the spiral structure for sensing any moisture, any leakage along the longitudinal direction of the separation part will give a detection, as the circumferential cavity is extending along the longitudinal direction of the separation part, and one leakage at one position, will fill the interior of the circumferential cavity giving an indication on the sensor and the communication means will present the moisture detection, giving an early warning to the plant operator of a critical wear of the separation part.

In one of the embodiments, the edge is rounded to provide a smooth transition from a smaller diameter to a greater diameter. The shape and scale of the rounded edge is influential in the degree of disturbance generated. The concept of a rounded edge requires that the dimensions do not cause a collapse of the air core structure in the cyclone during operation, rather they provide a smooth disturbance creating the re-mix and re-classifying opportunity. Thus, the use of rounded edges at limited heights are beneficial in creating the desired effect without disrupting the principles in operation of a cyclone. Also, a smooth transition will not be as affected by wear as a sharper transition.

Other objectives, features and advantages of the present invention will appear from the following detailed disclosure, from the attached claims, as well as from the drawings. It is noted that the invention relates to all possible combinations of features.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise. The steps of any method disclosed herein do not have to be performed in the exact order disclosed, unless explicitly stated.

As used herein, the term "comprising" and variations of that term are not intended to exclude other additives, components, integers or steps.

BRIEF DESCRIPTION OF THE DRAWINGS

The invention will be described in more detail with reference to the appended schematic drawings, which show an example of a presently preferred embodiment of the invention.

DETAILED DESCRIPTION

Figure 1:
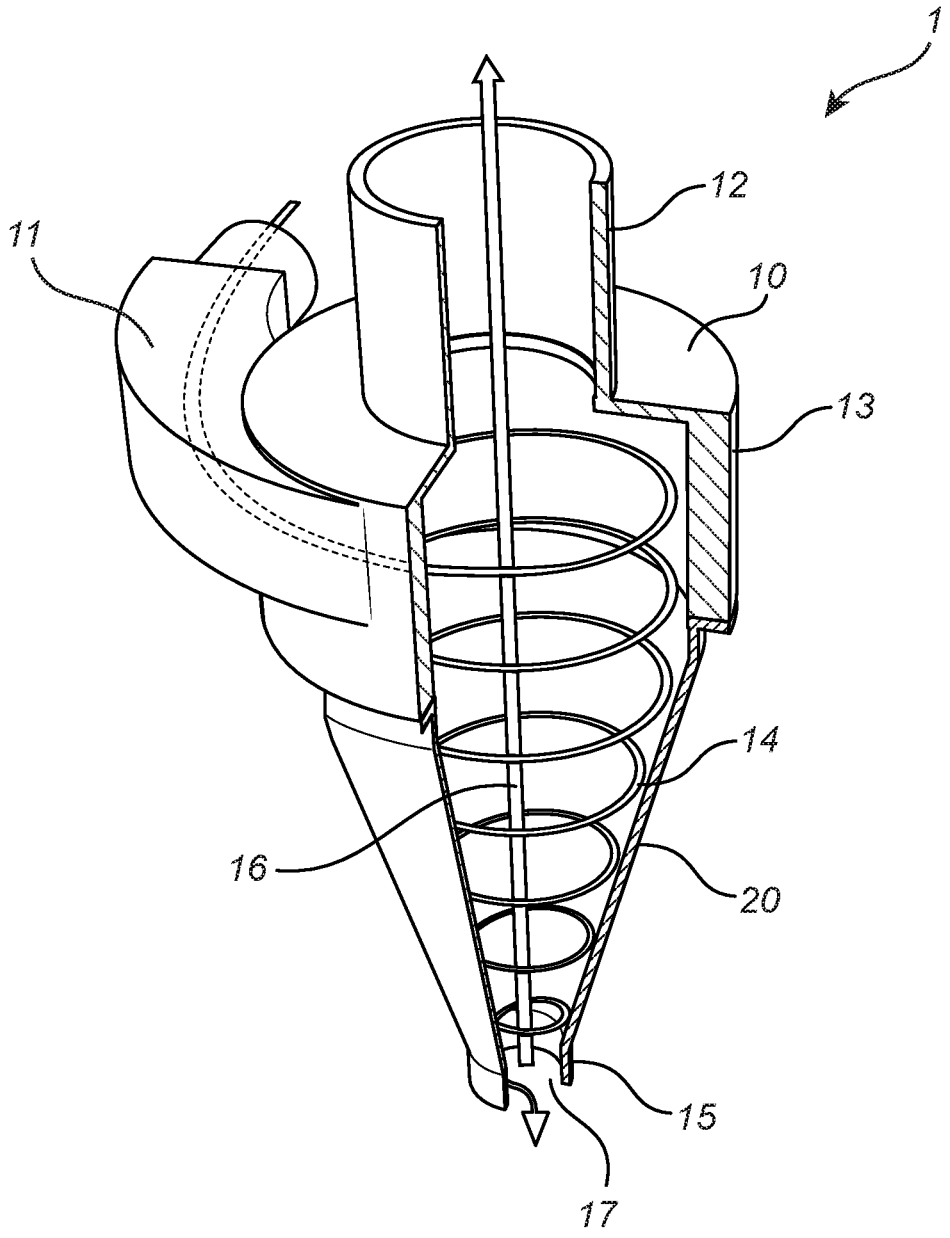
Fig. 1 Prior Art
FIG. 1 is a schematic view of a hydrocyclone separator as known in the prior art.

The present invention will now be described more fully hereinafter with reference to the accompanying drawings, in which currently preferred embodiments of the invention are shown. The present invention may, however, be embodied in many different forms and should not be construed as limited to the embodiments set forth herein; rather, these embodiments are provided for thoroughness and completeness, and to fully convey the scope of the invention to the skilled addressee. Like reference characters refer to like elements throughout.

FIG. 1 shows a schematic view of a prior art hydrocyclone separator 1. That hydrocyclone separator 1 comprises a cylindrical head part 10. An inlet conduit 11 is arranged to feed a suspension of solid material into the cylindrical head part 10, and an overflow discharge tube 12 is arranged axially through the top of the cylindrical head part 10. The cylindrical head part 10 is connected with a conically tapered separation part 20. The slurry is typically fed tangentially or in a volute path through the outer wall 13 of the head part 10, thus creating a whirling motion 14 of the slurry which follows a path of gradually decreasing radius toward the point of the narrowest radius of the cone and apex 15. As the spiral path approaches the apex 15 of the hydrocyclone 1, a portion 16 of it turns and begins to flow towards the opposite end, i.e. towards the head part. Also this flow 16 is in a spiral path of radius smaller than the radius of the first spiral 14 while rotating in the same direction. Thus a vortex is generated within the hydrocyclone 1. The pressure will be lower along the central axis of the vortex and increase radially outwardly towards the outer wall 13 of the hydrocyclone 1. The hydrocyclone 1 will separate the particles of the slurry according to shape, size and specific gravity with faster settling particles moving towards the outer wall of the hydrocyclone 1 eventually leaving the hydrocyclone through the underflow 17. Slower settling particles will move towards the central axis and travel upwardly, eventually leaving the hydrocyclone through a discharge tube 12 (overflow). The discharge tube 12 is normally extending down into the head part 10 such that a short circuiting of the feed is prevented. This separation according to shape, size and specific gravity can be denominated "stratification".

Figures 2, 3:
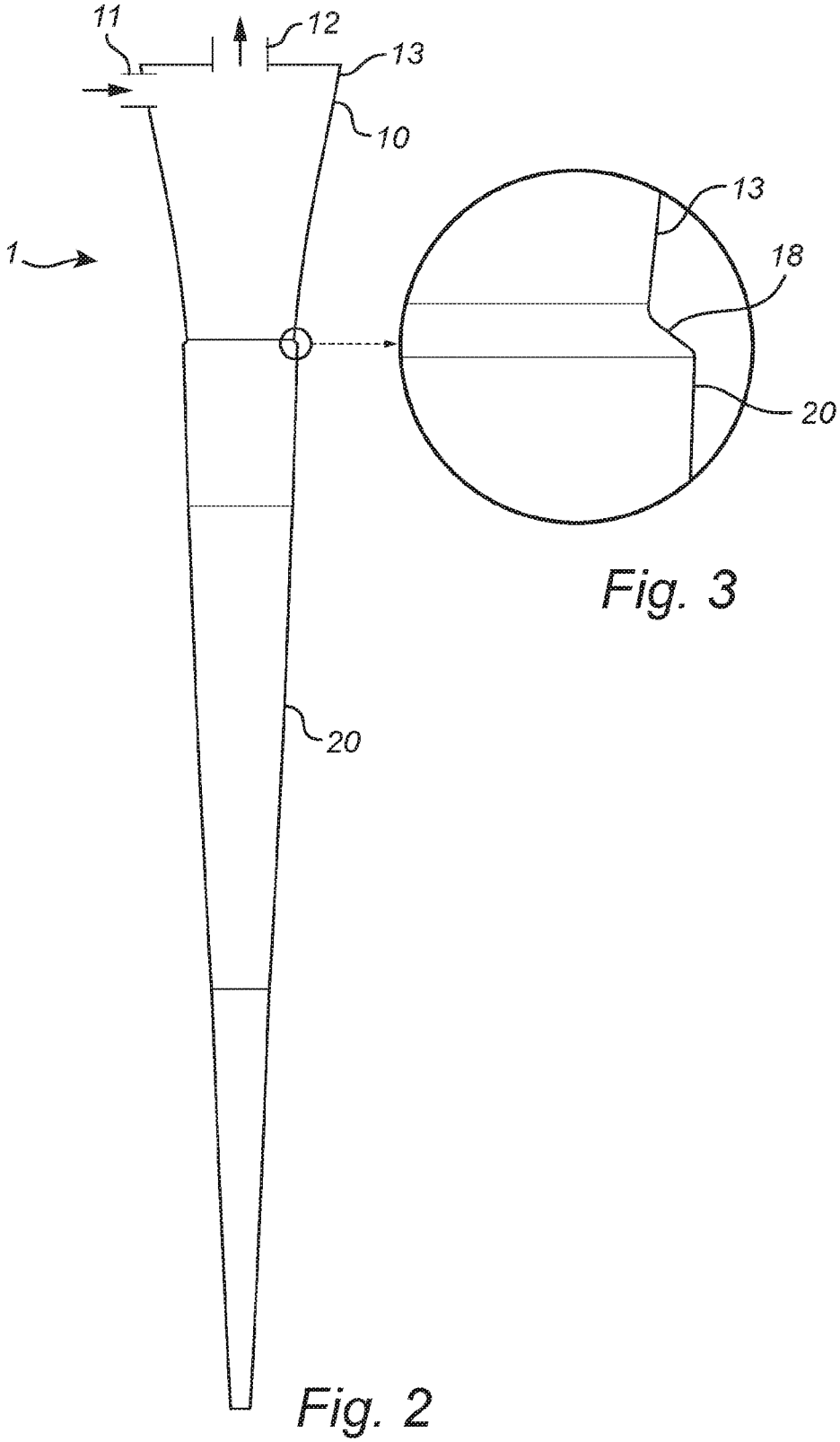
FIG. 2 is a schematic view of a hydrocyclone separator of an embodiment of a first aspect of the invention.
FIG. 3 is a detail of the hydrocyclone disclosed in FIG. 2.

FIG. 2 shows a cross-section of an embodiment of the first aspect of the invention. The hydrocyclone 1 according to this aspect of the invention comprises a head portion 10 which here is illustrated as being generally cylindrical. The skilled person realizes, however, that further shapes are conceivable, such as a cone shape or a curved shape. A cone shaped head part could for example have a cone angle of between 0 to 20 degrees. In the connection between the head part 10 and an underlying conically tapered separation part 20, an edge 18 is arranged. This edge 18 is achieved by providing a head part 10 having a diameter at a lower end thereof which is somewhat smaller than that of the upper end of the underlying conically tapered separation part 20. When material entering the hydrocyclone 1 through inlet 11, on its way down through the hydrocyclone, reaches the edge 18, the flow will be disturbed to a certain extent. By creating a disturbance in the material flow against the walls of the cyclone coarser material can be forced away from the wall to re-mix with adjacent flow for the purpose of dislodging build-up against the walls and freeing entrained fine materials from the wall region which were trapped by the coarse build-up. Put another way, the provision of an edge, particles that for some reasons are entrapped in an incorrect position within the hydrocyclone can be freed and be allowed to assume a correct position. Thereby stratification of the flow of material and the quality of classification can be improved. Further, as indicated above, the pressure in a hydrocyclone varies along a radius thereof and the difference in pressure occurring at an edge, due to the variation in diameter will cause particles to be set free and allowed to re-mix within the hydrocyclone. Also, particles that are stuck to each other, e.g. particles of less size stuck to particles of greater size, can break loose due to the shock occurring when the flow goes from the reduced diameter of the head part 10 to the greater diameter of conically tapered separation part 20. The detachment of particles from each other enables better stratification of the material to be classified. As indicated in FIG. 3, which is a detail of the hydrocyclone 1 shown in FIG. 2, the widening of the diameter at edge 18 may be provided with a smooth transition. A smooth edge will not cause a collapse of the air core structure in the cyclone during operation, causing what is called "roping" wherein separation efficiency will fall, and oversize material will discharge through the overflow. Instead a smooth edge provides a smooth disturbance creating the re-mix and re-classifying opportunity. Thus, the use of rounded edges at limited heights is beneficial in creating the desired effect without disrupting the principles in operation of a cyclone. Also, a smooth transition will not be as affected by wear as a sharper transition. Further, and as shown in FIG. 2, the conically tapered separation part 20 may be provided with a variation of the cone angle. For example, the cone angle may be relatively low in a first section, higher in a second section and slightly lower again in a third section. Other combinations may of course also be provided, depending on specific requirement in different situations.

Figure 4:
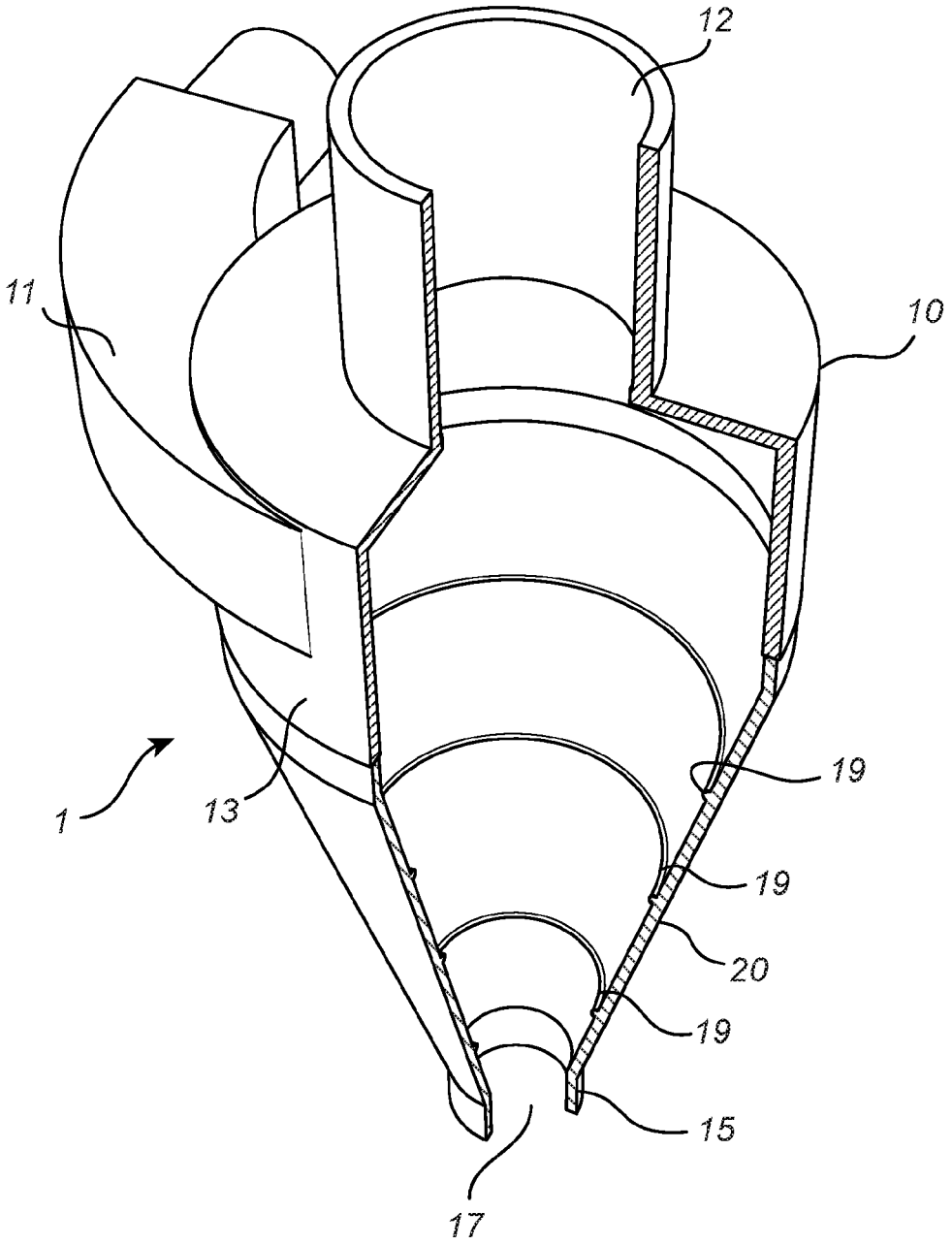
FIG. 4 is a cross-sectional view of a hydrocyclone separator of a first embodiment of a second aspect of the invention.
Figure 5:
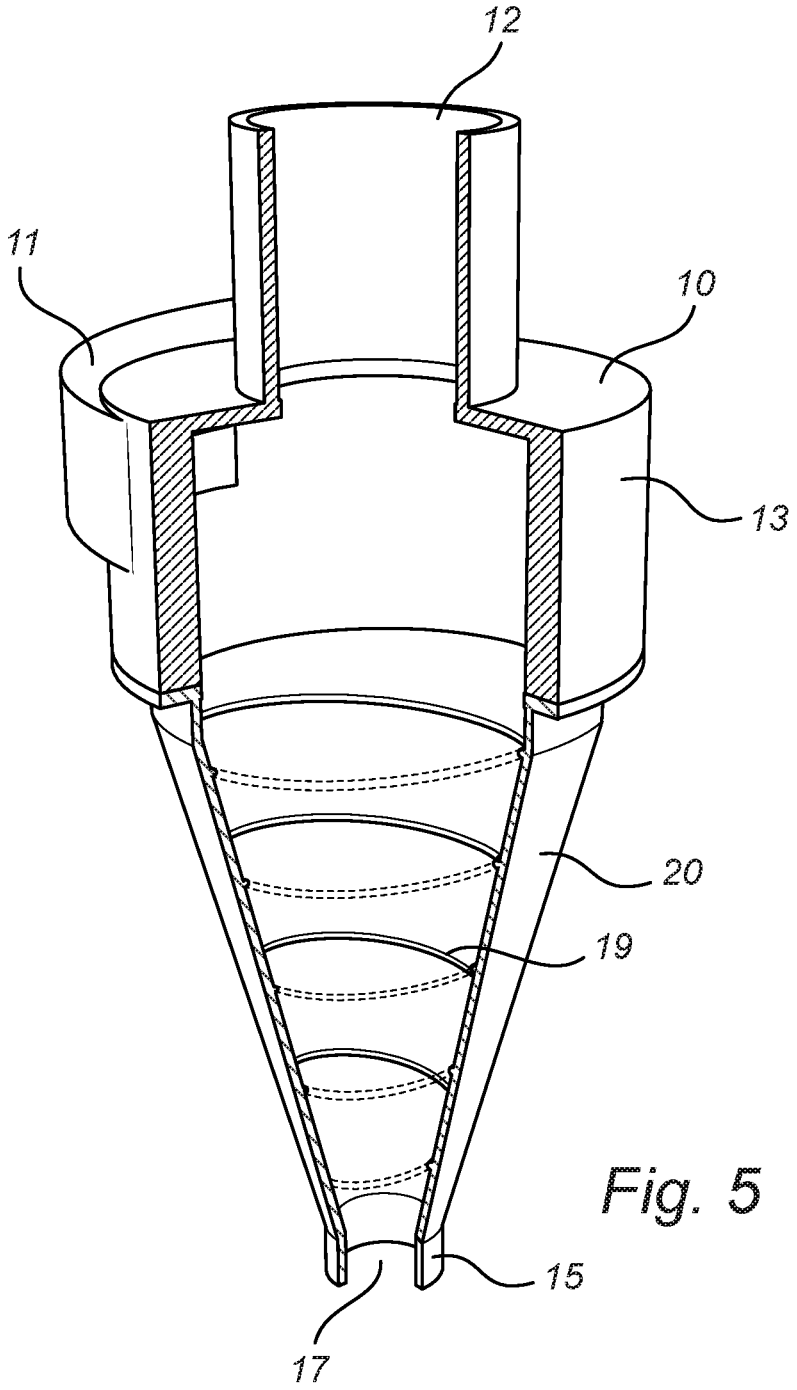
FIG. 5 is a cross-sectional view of a hydrocyclone separator of a second embodiment of the second aspect of the invention.

In FIGS. 4 and 5 embodiments of the second aspect of the invention are shown. Here, grooves 19 are providing the disturbance to the flow of material. As the flow passes the grooves 19, which may be provided in the form of recesses or protrusions at the inner surface of the conically tapered separation part 20, similar to the embodiment previously described regarding FIGS. 2 and 3, the particles are subjected to a the previously described effect which detaches particles that are stuck to each other and forces particles to be re-mixed, thus improving the stratification action of the hydrocyclone 1. In FIG. 4, the grooves 19 are arranged in a plurality of planes, each lying substantially perpendicular to a longitudinal axis of the hydrocyclone 1. Of course, it is also possible to provide a single groove 19 lying in a plane substantially perpendicular to a longitudinal axis of the hydrocyclone 1 or in a plane inclined to a longitudinal axis of the hydrocyclone 1. It is also possible to arrange the grooves 19 in a plurality of planes, each being inclined to a longitudinal axis of the hydrocyclone 1. Combinations of inclined and perpendicular planes are also conceivable within the scope of the present invention. Further, the groove or grooves 19 may extend along the whole perimeter of the conically tapered separation part 20 or may extend only along a part of the perimeter of the conically tapered separation part 20, i.e. in the form of an arc. The number of grooves, their extent and inclination are all parameters that can be adjusted in order to provide desirable properties of the hydrocyclone 1 as required in specific situations. Another embodiment is shown in FIG. 5. Here the groove(s) 19 are arranged along a helical path at the inner surface of the conically tapered separation part 20. In a preferred embodiment the helical path of the grooves 19 runs in a direction countercurrent to the flow of material but it is also possible to run with the current of the flow of material. The helical groove running counter current provides for increased interaction between the slurry and the groove(s). The pitch of a helical path running with the current should be selected such that it is ensured that the flow of material passes over the groove(s) 19 even though they run with the current of the flow of the material. For both the embodiment described in FIG. 4 and the of FIG. 5, the provision of smooth protrusions and/or recesses provides the same advantages as described earlier with respect to the smooth edges.

Figure 6:
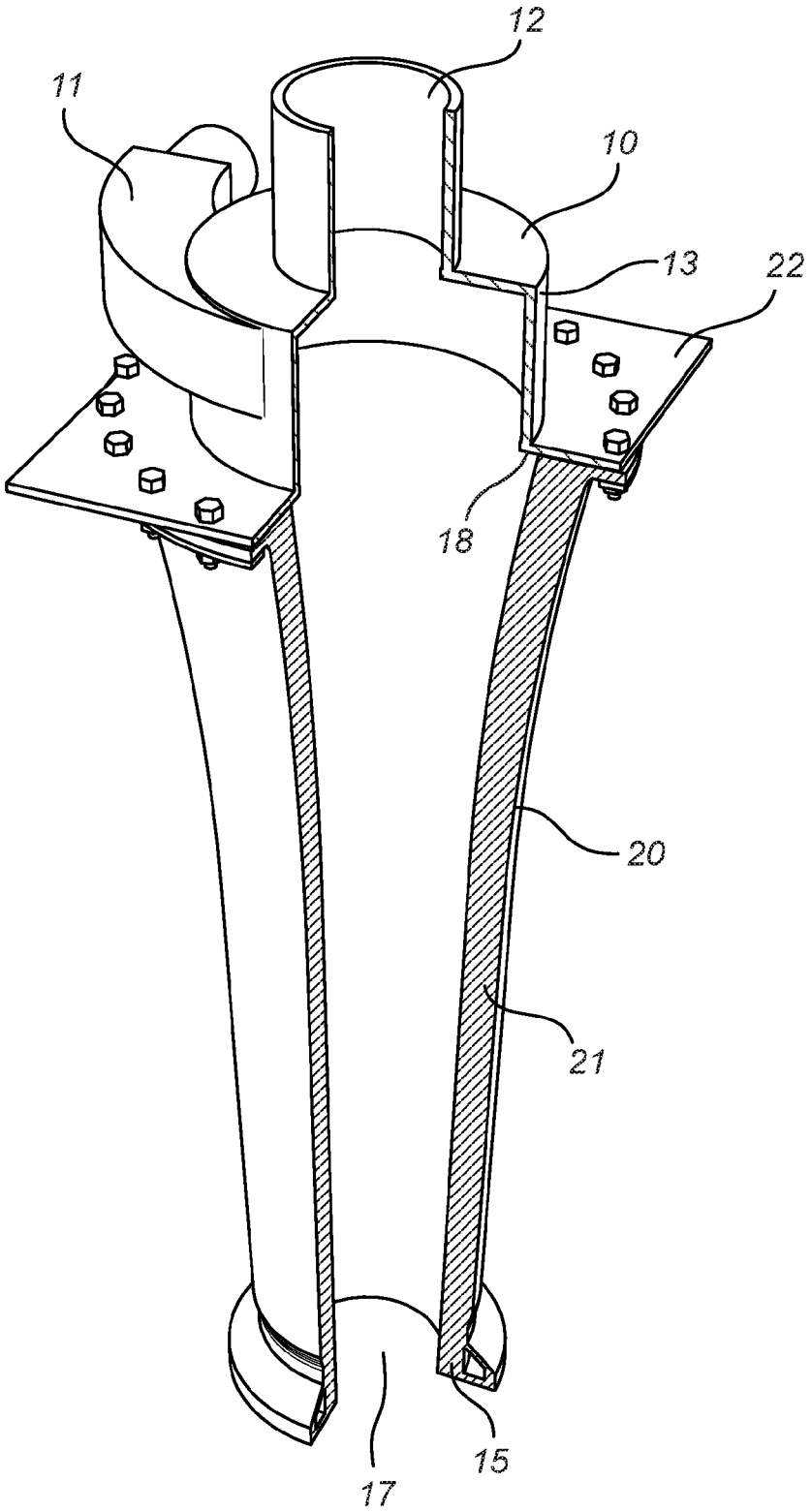
FIG. 6 is a cross-sectional view of a hydrocyclone separator of a first embodiment of a third aspect of the invention.

FIG. 6 shows an embodiment of a third aspect of the invention. Here, the conically tapered separation part 20 comprises a hose segment 21. The hose segment 21 is attached to the head part 10 by means of flange 22, fastened by screws and nuts or similar joint means. Similar to the solution described in FIGS. 2 and 3, the inner diameter at the upper end of the conically tapered hose segment 20, 21 is greater than the inner diameter at the lower end of the head part 10 such that an edge 18 is created which disturbs a flow of material passing the edge 18. However, it is of course possible to provide the inner surface of the hose segment 21 with grooves 19 as described above with respect to the second aspect of the invention. Such grooves 19 can also be combined with an edge 18 arranged between the head part 10 and hose segment 21. The use of a hose segment 21 provides for a durable separation part 20 in a hydrocyclone 1 since hose material typically has good wear properties and can easily be provided with e.g. ceramics or other wear improving material on the inner surface of the hose segment. Furthermore, hosing material is flexible and can if desired be designed to adapt to the load applied to it. A hose is typically a layered product manufactured on a mandrel which design can easily be adapted to more or less any desired shapes and sizes that might be desired in order to achieve an optimized separation part 20 for a specific process. Even complicated shapes with varying radiuses and diameters of the hose segment can be achieved without much extra work. The stiffness of the hose segment 21 can also be adapted as required in each and every specific situation by providing a hose segment with a suitable numbers of layers, (e.g. an interior wear layer, a support and an exterior cover layer) having suitable respective stiffness properties. In comparison with conically tapered parts made from e.g. steel a hose segment is easier to manufacture, cheaper and more formable and even very complicated shapes can be manufactured in one single piece. Since no complicated and expensive moulds are required, the manufacturing costs can be kept at bay. By arranging a flange at the end of the hose segment a simple and reliable connection to the head part can be achieved and exchange of worn out parts is further simplified by the fact that a hose segment can be provided in a single element without any wrapping or similar. Of course, the inner surface of the hose segment 21 can be provided with groove(s) 18 as described above, in addition to the edge 18 between hose segment 21 and head part 10 or instead of such edge 18. Also, thanks to the workability of the hose material, different portions of the hose segment 21 may have different diameters and different cone angles. Further, parts or the whole of the inner surface of the hose segment 21 may be provided with wear improving materials such as ceramics.

In another embodiment of this aspect of the invention, the hose segment 21 is provided with a monitoring system comprising at least one moisture sensor 30 arranged to detect moisture in or at said support structure; and communication means 60 coupled to said moisture sensor 30 for providing a signal representative of moisture detection in or at said support structure. An additional pressure sensor 40 may also be provided in or at said support structure and communication means 60 coupled to said pressure sensor 40 for providing a signal representative of pressure detection in or at said support structure. At present, most hoses used are normally completely worn through before the wear is detected. This can cause leakage of material, which is not only a danger to personnel due to the high pressure of the material in the hydrocyclone, but the spillage may be an environmental hazard, as well as the obvious loss in production. It is therefore an advantage that the plant operator can be pre-warned of such a situation and therefore it is desirable to detect such wear locations and pre-warn the plant operator to prevent wearing the hose segments completely through, and enable having the hose segment exchange before it comes to a critical situation.

Figure 7:
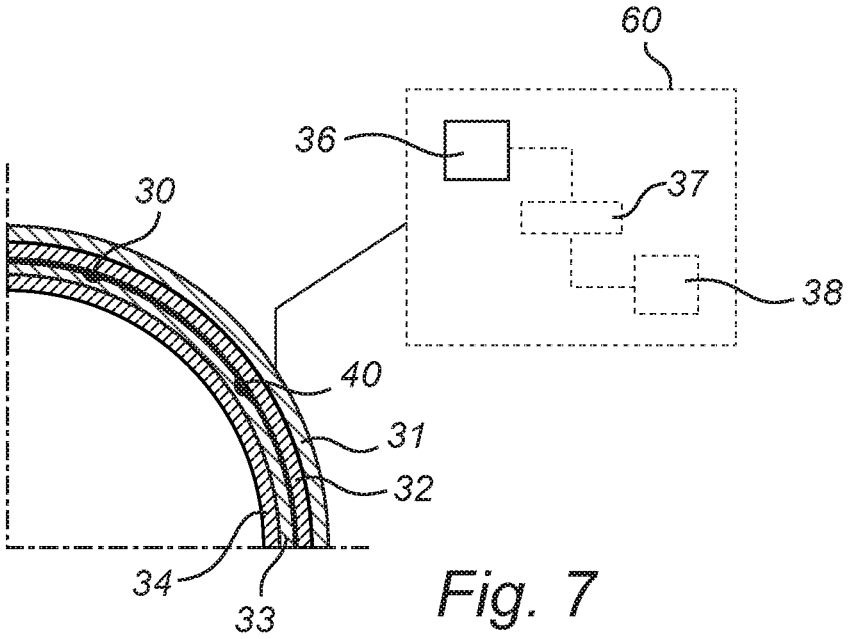
FIG. 7 is a cross-sectional view of a conically tapered separation part of a second embodiment of the third aspect of the invention.
Figure 8:
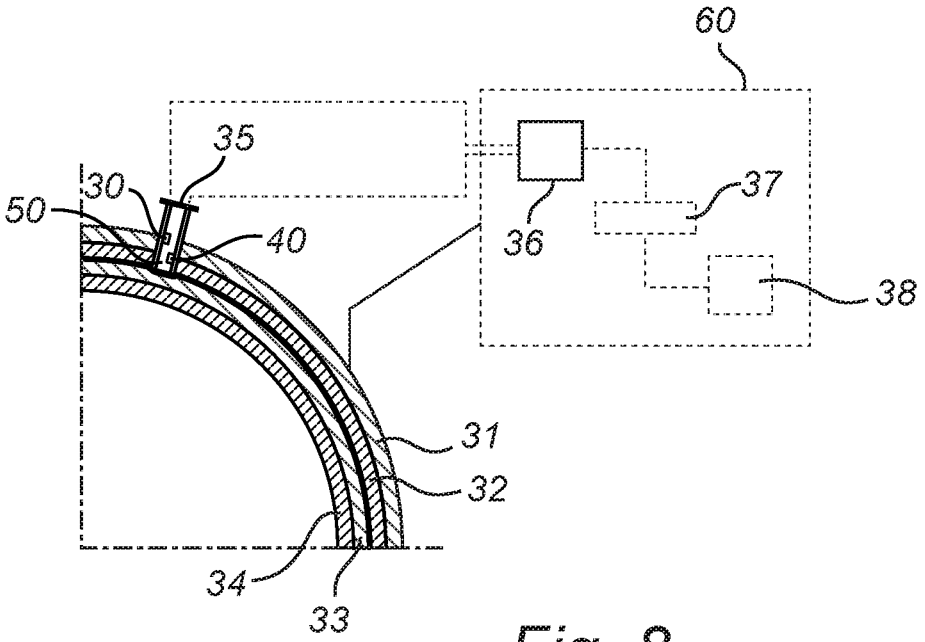
FIG. 8 is a cross-sectional view of a conically tapered separation part of a third embodiment of the third aspect of the invention.

FIGS. 7 and 8 show two versions of how the hose segment 21 may be structured and how the moisture sensor 30 and the pressure sensor 40 may be arranged within the hose segment 21. FIGS. 7 and 8 show a partial magnification of a hose segment 21 showing the different wall layers thereof. The layer marked with reference number 34 is an interior wear layer having an inner surface, which is adapted for contact with solid material in a fluid, and an outer surface. The layers marked with reference number 32 and 33 are two cord layers, which cord layers are arranged to circumvent the outer surface of the first layer to provide pressure leveling around and along the hose segment. Thus, in this embodiment the support structure comprises the two cord layers 32 and 33. And finally, the layer marked with reference number 31 is an exterior cover layer being disposed over the outermost cord layer 32. In the embodiment shown in FIG. 7 a monitoring system has been arranged during manufacturing of the hose segment. A wireless moisture sensor 30 has been positioned in between the two cord layers 32 and 33 to be aligned and detect any moisture being guided along or within the support structure comprising the cord layers 32 and 33. The cord with its warp wires will lead and guide the fluid leakage along the supporting structure to the sensor and will give an indication on the sensor. In the embodiment in FIG. 7 a an optional wireless pressure sensor 40 has also been positioned in between the two cord layers 32 and 33 to be aligned and detect any moisture being guided along or within the support structure comprising the cord layers 32 and 33. The moisture sensor and the pressure sensor may comprise wireless sensors e.g. based on Radio-frequency identification (RFID). In the embodiment shown in FIG. 8 a monitoring system has been arranged to detect moisture in said support structure, i.e. the cord layers 32 and 33. The monitoring system has been arranged by cutting through the exterior cover layer 31 and the first cord layer 32 providing a sensor cavity 50. The moisture sensor 30 is positioned within the sensor cavity 50 or at the closing wall 35. A pressure sensor 40 may also be arranged within the sensor cavity 50 or at a closing wall 35. The sensor cavity 50 is sealed tight from the outside of the hose. As further schematically illustrated in FIGS. 7 and 8, the moisture sensors 30 are arranged in communication with communication means 60, which also may comprise an automatic monitoring system. When having hose segments 21 arranged in a hydrocyclone, each hose segments 21 has at least one separate moisture sensor 30 and optionally at least one separate pressure sensor 40, any detection of moisture and/or a pressure detection above a threshold value will set out a warning which is device specific, and the plant operator will be able to identify which hose segment needs to be replaced. If a plurality of hose segments is commonly mounted together, each segment has its own at least one moisture sensor 30 and optionally at least one pressure sensor 40, and when detecting an alarm, the plant operator will know which segment of the hose to replace. When detecting moisture entering into the supporting structure of the hose segment 21, or into a cavity created between the support structure and an adjacent layer of the hose segment, this may be seen as an early warning of wear, and when detecting a pressure above a predetermined threshold value this is a another warning that a hose segment soon may break and/or burst and that a process stop and replacement of indicated hose segment is recommended. By monitoring the early moisture detection, and timing thereof, the plant operator have the possibility to make reasonable and cost effective process stop and maintenance in the hydrocyclone.

The skilled person realizes that a number of modifications of the embodiments described herein are possible without departing from the scope of the invention, which is defined in the appended claims. For example, the separation part according to the invention need not necessarily be conical in a strict meaning. As long as the inner diameter is generally reduced from a top end towards a bottom end, it can have a plurality of different cone angles along its longitudinal axis and can also have more of a curved appearance, i.e. having a continuously changing cone angle. The skilled person also realizes that an edge could be arranged anywhere along the longitudinal axis of the separation part, even at or near the underflow. A groove, as described in relation with the separation part, can also be arranged at the head part.

We claim:

1. A hydrocyclone separator for classifying solid material in fluid suspension, comprising:

a head part having an inlet conduit adapted to feed a suspension into the head part; and a conically tapered separation part, wherein an upper end of the conically tapered separation part is coupled to a lower end of the head part and wherein an inner diameter at the upper end of the conically tapered separation part is greater than an inner diameter at the lower end of the head part such that an edge is created which disturbs a flow of material passing said edge, and wherein a groove is provided on an inner surface of the conically tapered separation part such that a groove edge is created which disturbs a flow of material passing said groove edge, which groove extends along a helical path on the inner surface of the conically tapered separation part.

2. A hydrocyclone separator for classifying solid material in fluid suspension, comprising:

a head part having an inlet conduit adapted to feed a suspension into the head part; and a conically tapered separation part, wherein an upper end of the conically tapered separation part is coupled to a lower end of the head part and wherein a groove is provided on an inner surface of the conically tapered separation part such that an edge is created which disturbs a flow of material passing said edge, which groove extends along a helical path on the inner surface of the conically tapered separation part.

3. A hydrocyclone separator according to claim 2, wherein the groove is provided in the form of a recess in the inner surface of the conically tapered separation part.

4. A hydrocyclone separator according to claim 2, wherein the groove extends in the shape of an arc.

5. A hydrocyclone separator according to claim 2, wherein the groove extends along a perimeter of the conically tapered separation part.

6. A hydrocyclone separator according to claim 2, wherein the helical path on the inner surface of the conically tapered separation part extends countercurrent to a flow of the solid material in fluid suspension.

7. A hydrocyclone separator according to claim 1, wherein the conically tapered separation part comprises a plurality of segments and wherein an inner diameter of a lower end of an upper segment is less than an inner diameter of an upper end of an adjacent lower segment such that a second edge is created.

8. A hydrocyclone separator according to claim 2, wherein the conically tapered separation part comprises a plurality of segments and wherein an inner diameter of a lower end of an upper segment is less than an inner diameter of an upper end of an adjacent lower segment such that an edge is created.

9. A hydrocyclone separator according to claim 1, wherein the conically tapered separation part comprises a plurality of segments and wherein the different segments have different taper angles.

10. A hydrocyclone separator according to claim 1, wherein the edge is rounded to provide a smooth transition from a smaller diameter to a greater diameter.

11. System for classification of particles, comprising one or more hydrocyclones as described in claim 1.

12. A hydrocyclone separator according to claim 1, wherein the helical path on the inner surface of the conically tapered separation part extends countercurrent to a flow of the solid material in fluid suspension.

* * * * *